US010060373B2

(12) United States Patent
Wang et al.

(10) Patent No.: US 10,060,373 B2
(45) Date of Patent: Aug. 28, 2018

(54) LINEAR PARAMETER VARYING MODEL PREDICTIVE CONTROL FOR ENGINE ASSEMBLIES

(71) Applicant: GM GLOBAL TECHNOLOGY OPERATIONS LLC, Detroit, MI (US)

(72) Inventors: Yue-Yun Wang, Troy, MI (US); Ruixing Long, Windsor (CA); Julian R. Verdejo, Novi, MI (US); Jyh-shin Chen, Troy, MI (US)

(73) Assignee: GM Global Technology Operations LLC, Dearborn, MI (US)

( * ) Notice: Subject to any disclaimer, the term of this patent is extended or adjusted under 35 U.S.C. 154(b) by 58 days.

(21) Appl. No.: 15/408,776

(22) Filed: Jan. 18, 2017

(65) Prior Publication Data

US 2018/0202380 A1 Jul. 19, 2018

(51) Int. Cl.
*F02D 41/14* (2006.01)

(52) U.S. Cl.
CPC .. *F02D 41/1402* (2013.01); *F02D 2041/1412* (2013.01); *F02D 2200/1002* (2013.01)

(58) Field of Classification Search
CPC ..... F02D 41/1402; F02D 2041/1412; F02D 2200/1002
USPC ..... 701/102
See application file for complete search history.

(56) References Cited

U.S. PATENT DOCUMENTS 7,810,476 B2 10/2010 Wang et al.
8,091,416 B2 1/2012 Wang et al.
8,201,444 B2 6/2012 Wang et al.
8,276,373 B2 10/2012 Wang et al.
8,392,091 B2 3/2013 Hebbale et al.
8,612,119 B2 12/2013 Wang et al.
8,694,197 B2 4/2014 Rajagopalan et al.
9,133,750 B2 9/2015 Levijoki et al.
2008/0051973 A1 2/2008 Gangopadhyay et al.
2009/0182485 A1* 7/2009 Loeffler ..... F02D 35/023 701/103
2012/0085082 A1 4/2012 Levijoki et al.
2012/0286063 A1 11/2012 Wang et al.
2015/0275784 A1* 10/2015 Whitney ..... F02D 13/02 701/102
2015/0275785 A1* 10/2015 Cygan, Jr. ..... F01L 1/34409 701/102

(Continued)

*Primary Examiner* — Mahmoud Gimie
(74) *Attorney, Agent, or Firm* — Quinn IP Law

(57) ABSTRACT

An LPV/MPC engine control system is disclosed that includes an engine control unit connected to multiple sensors. The engine control unit receives, from the sensors, signals indicative of desired engine torque and engine torque output, and determines, from these signals, optimal engine control commands using a piecewise LPV/MPC routine. This routine includes: determining a nonlinear and a linear system model for the engine assembly, minimizing a control cost function in a receding horizon for the linear system model, determining system responses for the nonlinear and linear system models, determining if a norm of an error function between the system responses is smaller than a calibrated threshold, and if the norm is smaller than the predetermined threshold, applying the linearized system model in a next sampling time for a next receding horizon to determine the optimal control command. Once determined, the optimal control command is output to the engine assembly.

20 Claims, 3 Drawing Sheets

(56) References Cited

U.S. PATENT DOCUMENTS

| | | | | |
|---|---|---|---|---|
| 2015/0275792 | A1* | 10/2015 | Genslak | F02D 41/0255 60/274 |
| 2015/0275795 | A1* | 10/2015 | Cygan, Jr. | F02D 41/0255 701/102 |
| 2016/0363057 | A1* | 12/2016 | Cygan, Jr. | F02D 13/0207 |

* cited by examiner

LINEAR PARAMETER VARYING MODEL PREDICTIVE CONTROL FOR ENGINE ASSEMBLIES

INTRODUCTION

The present disclosure relates generally to model-based control for regulating operation of engine assemblies. More specifically, aspects of this disclosure relate to model predictive control strategies for internal combustion engine assemblies.

Current production motor vehicles, such as the modern-day automobile, are originally equipped with a powertrain that operates to propel the vehicle and power the onboard vehicle electronics. The powertrain, which is inclusive of, and oftentimes misclassified as, a vehicle drivetrain, is generally comprised of a prime mover that delivers driving power to the vehicle's final drive system (e.g., differential, axle, and road wheels) through a multi-speed power transmission. Automobiles have generally been powered by a reciprocating-piston type internal combustion engine (ICE) because of its ready availability and relatively inexpensive cost, light weight, and overall efficiency. Such engines include two and four-stroke compression-ignited (CI) diesel engines, four-stroke spark-ignited (SI) gasoline engines, six-stroke architectures, and rotary engines, as some non-limiting examples. Hybrid vehicles, on the other hand, utilize alternative power sources, such as battery powered electric motor-generators, to propel the vehicle, minimizing reliance on the engine for power and, thus, increasing overall fuel economy.

A typical overhead valve internal combustion engine includes an engine block with a series of cylinder bores, each of which has a piston reciprocally movable therein. Coupled to a top surface of the engine block is a cylinder head that cooperates with the piston and cylinder bore to form a variable-volume combustion chamber. These reciprocating pistons are used to convert pressure—generated by igniting a fuel-and-air mixture compressed inside the combustion chamber—into rotational forces to drive a crankshaft. The cylinder head defines intake ports through which air, provided by an intake manifold, is selectively introduced to each combustion chamber. Also defined in the cylinder head are exhaust ports through which exhaust gases and byproducts of combustion are selectively evacuated from the combustion chambers to an exhaust manifold. The exhaust manifold, in turn, collects and combines exhaust gases for recirculation into the intake manifold, delivery to a turbine-driven turbocharger, and/or evacuation from the ICE via an exhaust system.

Exhaust gases produced during each combustion work cycle of an ICE assembly normally includes particulate matter and other known by-products of combustion, such as carbon monoxide (CO), hydrocarbons (HC), volatile organic compounds (VOCs), and nitrogen oxides (NOx). Exhaust aftertreatment systems operate to oxidize unburned hydrocarbons and carbon monoxide to carbon dioxide and water, and to reduce mixtures of nitrogen oxides to nitrogen and water before the gas is released into the atmosphere. Exhaust treatment may incorporate, singly and in any combination, an oxidation catalyst (OC), NOx absorbers/adsorbers, exhaust gas recirculation (EGR), a selective catalytic reduction (SCR) system, a particulate matter (PM) filter, catalytic converters and other means of emissions control. Selective catalytic reduction is an advanced active emissions control technology that injects a dosing agent, such as anhydrous or aqueous ammonia ($NH_3$) or automotive-grade urea (otherwise known as Diesel Exhaust Fluid (DEF)), into the exhaust gas stream. This dosing agent includes a reductant that reacts and mixes with the NOx in the exhaust gas, and the mixture may be absorbed onto an SCR catalyst. The SCR catalyst may then break down the absorbed mixture forming water vapor ($H_2O$) and nitrogen gas ($N_2$).

SUMMARY

Disclosed herein are multivariable model predictive control systems for regulating operation of engine assemblies, methods for making and methods for using such model predictive control systems, and motor vehicles with an internal combustion engine assembly and exhaust aftertreatment system having closed-loop torque and emission control capabilities. By way of example, and not limitation, there is presented a novel piecewise linear parameter varying (LPV) model predictive control (MPC) strategy and architecture for regulating operation of engine systems. In this new solution, a nonlinear physics-based plant model is built or otherwise retrieved, e.g., for an engine air-charging system and torque model. The nonlinear plant model is then linearized at a current operating condition, and system dynamic matrices A, B, C, D and V are calculated, for example, based on the Jacobian of the nonlinear system, e.g., partial derivatives with respect to system states and inputs.

Once the nonlinear plant model is linearized, a control cost function in receding finite time horizon is optimized against the current linearized system, and a control solution is determined for a current step. Both the nonlinear system response and the linearized system response may be simulated with a current optimal control input u(k). A vector or time series norm may be calculated based on an error function between the two responses; if the norm is smaller than a predetermined threshold, this linearized system or the A, B, C, D and V matrices, or both, can be re-used in a next sampling time for a next receding horizon to find an optimal control u(k+1). This process iterates in a continuous loop, for example, until a norm of the error response is deemed to be no longer acceptable. When no longer acceptable, a new linearized system model is obtained to calculate a new control series. Generally speaking, zones may be determined based on physics plant models on-line because the design process includes calibrating the nonlinear plant model, and does not per se require partitioning or determining control zones through extensive experiment.

Attendant benefits for at least some of the disclosed concepts include engine system control logic that helps to reduce system calibration time and computational load required by known zone-based linearization control schemes and conventional MPC control schemes. Unlike known MPC control methodologies, disclosed piecewise LPV MCP control logic does not require increased computational load capacity for achieving an infinite zone solution. In the same vein, unlike zone-based linearization of nonlinear systems using engine system identification, disclosed systems, methods and devices do not require extensive testing or time-consuming calibration for determining numerous zones to ensure adequate partition e.g., to guarantee system robustness. Disclosed algorithms and architectures may be operable to apply closed-loop torque and emission control using real-time torque sensor or stored model data, as well as real-time NOx out sensor data. Disclosed algorithms and architectures may be extended to include real-time particulate sensor feedback control.

Aspects of the present disclosure are directed to multivariable model predictive control systems for regulating operation of reciprocating-piston type internal combustion engine assemblies. Disclosed, for example, is an LPV/MPC engine control system for an engine assembly. This LPV/MPC engine control system includes an engine sensor that detects engine torque output of the engine assembly and generates signals indicative thereof, and an input sensor that detects desired engine torque for the engine assembly and generates signals indicative thereof. An engine control unit is communicatively connected to the engine sensor and the input sensor to receive sensor signals indicative of a desired engine torque and an engine torque output. The engine control unit is programmed to determine, from the desired engine torque and engine torque output, an optimal control command using a piecewise LPV/MPC routine and, once determined, output the optimal control command to the engine assembly. The piecewise LPV/MPC routine includes instructions to: determine a nonlinear system model of engine torque for the engine assembly; determine a linear system model for the engine assembly at a current engine operating condition; minimize a control cost function in a receding horizon for the linear system model; determine respective system responses for the nonlinear and linear system models with a current optimal control input; determine if a norm of an error function between the system responses is smaller than a predetermined threshold; and, responsive to a determination that the norm is smaller than the predetermined threshold, apply the linearized system model in a next sampling time for a next receding horizon to determine the optimal control command.

If it is determined that the norm is smaller than the predetermined threshold, the piecewise LPV/MIPC routine may execute the following instructions in a continuous loop until the norm is not smaller than the threshold: minimize the control cost function at next sampling times k+1, 2 . . . N in respective next receding horizons for the linear system model; determine new respective system responses for the nonlinear and linear system models with the current optimal control input; and determine if the norm of the error function between the new system responses is smaller than the predetermined threshold. Responsive to a determination that the norm of the error function is not smaller than the predetermined threshold, the piecewise LPV/MPC routine may include instructions to: determine a new linear system model for the engine assembly, minimize the control cost function in a new receding horizon for the new linear system model, determine new respective system responses for the nonlinear system model and the new linear system model, and determine if the norm of the error function between the new system responses is smaller than the predetermined threshold.

Other aspects of the present disclosure are directed to motor vehicles with reciprocating-piston-type engine assemblies with multivariable engine torque and emission closed-loop control capabilities. A "motor vehicle," as used herein, may include any relevant vehicle platform, such as passenger vehicles (internal combustion engine, hybrid electric, full electric, fuel cell, fuel cell hybrid, fully or partially autonomous, etc.), commercial vehicles, industrial vehicles, tracked vehicles, off-road and all-terrain vehicles (ATV), farm equipment, boats, airplanes, etc. In an example, a motor vehicle is presented that includes a vehicle body with an engine compartment, and an internal combustion engine (ICE) assembly stowed, wholly or partially, inside the engine compartment. An engine sensor is operatively coupled to the ICE assembly and configured to detect engine torque output of the ICE assembly. An input sensor is configured to detect a driver's desired engine torque for the ICE assembly.

An engine control unit is communicatively connected to the ICE assembly, the engine sensor, and the input sensor. This engine control unit is programmed to: receive, from the engine and input sensors, signals indicative of a desired engine torque and an engine torque output; determine, from the engine torque output and the desired engine torque, an optimal control command using a piecewise LPV/MPC routine; and, once determined, output the optimal control command to the ICE assembly. The piecewise LPV/MPC routine includes processor-executable instructions for the ECU to: determine a nonlinear system model of engine torque for the ICE assembly; determine a linear system model for the ICE assembly at a current engine operating condition; minimize a control cost function in a receding horizon for the linear system model; determine respective system responses for the nonlinear and linear system models with a current optimal control input; determine if a norm of an error function between the system responses is smaller than a predetermined threshold, and responsive to a determination that the norm is smaller than the predetermined threshold, apply the linearized system model in a next sampling time for a next receding horizon, e.g., until the norm is greater than the predetermined threshold, to help determine the optimal control command. The foregoing steps can be performed in a continuous loop until the norm exceeds the threshold.

Additional aspects of this disclosure are directed to methods of making and methods of using multivariable model predictive control systems for regulating operation of reciprocating-piston type internal combustion engine assemblies. For instance, a method is disclosed for operating an LPV/MPC engine control system for an engine assembly. The method includes, in any order and in any combination with any of the disclosed features: receiving, from an engine sensor, a signal indicative of an engine torque output of the engine assembly; receiving, from an input sensor, a signal indicative of a desired engine torque for the engine assembly; determining, from the engine torque output and the desired engine torque, an optimal control command using a piecewise LPV/MIPC routine, including: determining a nonlinear system model of engine torque for the engine assembly, determining a linear system model for the engine assembly at a current engine operating condition, minimizing a control cost function in a receding horizon for the linear system model, determining respective system responses for the nonlinear and linear system models with a current optimal control input, determining if a norm of an error function between the system responses is smaller than a predetermined threshold, and responsive to a determination that the norm is smaller than the predetermined threshold, applying the linearized system model in a next sampling time for a next receding horizon to determine the optimal control command; and outputting the determined optimal control command to the engine assembly.

The above summary is not intended to represent every embodiment or every aspect of the present disclosure. Rather, the foregoing summary merely provides an exemplification of some of the novel aspects and features set forth herein. The above features and advantages, and other features and advantages of the present disclosure, will be readily apparent from the following detailed description of representative embodiments and representative modes for carrying out the present disclosure when taken in connection with the accompanying drawings and the appended claims.

Moreover, this disclosure expressly includes any and all combinations and subcombinations of the elements and features presented above and below.

Figure 1:
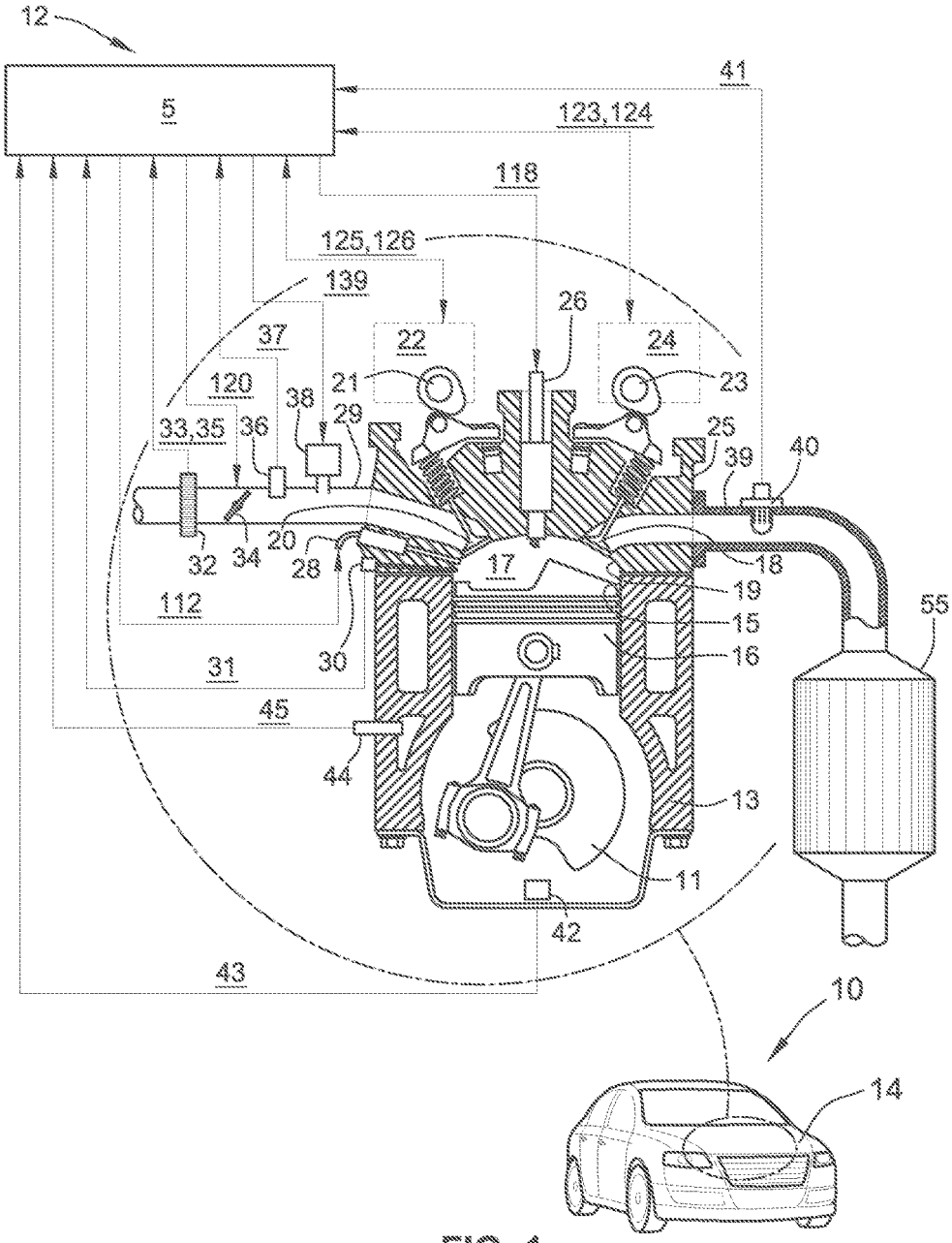
FIG. 1 is a front perspective-view illustration of a representative motor vehicle with an inset schematic illustration of a representative reciprocating-piston type internal combustion engine (ICE) assembly with linear parameter varying (LPV) model predictive control (MPC) capabilities in accordance with aspects of the present disclosure.

The present disclosure is susceptible to various modifications and alternative forms, and some representative embodiments have been shown by way of example in the drawings and will be described in detail herein. It should be understood, however, that the novel aspects of this disclosure are not limited to the particular forms illustrated in the appended drawings. Rather, the disclosure is to cover all modifications, equivalents, combinations, subcombinations, permutations, groupings, and alternatives falling within the scope and spirit of the disclosure as defined by the appended claims.

DETAILED DESCRIPTION

This disclosure is susceptible of embodiment in many different forms. There are shown in the drawings and will herein be described in detail representative embodiments of the disclosure with the understanding that these representative embodiments are to be considered an exemplification of the principles of the disclosure and are not intended to limit the broad aspects of the disclosure to the embodiments illustrated. To that extent, elements and limitations that are disclosed, for example, in the Abstract, Summary, and Detailed Description sections, but not explicitly set forth in the claims, should not be incorporated into the claims, singly or collectively, by implication, inference or otherwise. For purposes of the present detailed description, unless specifically disclaimed: the singular includes the plural and vice versa; the words "and" and "or" shall be both conjunctive and disjunctive; the word "all" means "any and all"; the word "any" means "any and all"; and the words "including" and "comprising" and "having" mean "including without limitation." Moreover, words of approximation, such as "about," "almost," "substantially," "approximately," and the like, may be used herein in the sense of "at, near, or nearly at," or "within 3-5% of," or "within acceptable manufacturing tolerances," or any logical combination thereof, for example.

Referring now to the drawings, wherein like reference numbers refer to like features throughout the several views, there is shown in FIG. 1 a perspective-view illustration of a representative automobile, which is designated generally at 10 and portrayed herein for purposes of discussion as a four-door sedan-style passenger vehicle. Mounted at a forward portion of the automobile 10, e.g., aft of a front bumper fascia and grille and forward of a passenger compartment, is an internal combustion engine (ICE) assembly 12 housed within an engine compartment covered by an engine hood 14. The illustrated automobile 10—also referred to herein as "motor vehicle" or "vehicle" for short—is merely an exemplary application with which the novel aspects and features of this disclosure may be practiced. In the same vein, the implementation of the present concepts into a spark ignited direct injection (SIDI) engine configuration should also be appreciated as an exemplary application of the novel concepts disclosed herein. As such, it will be understood that the aspects and features of the present disclosure may be applied to other engine architectures, implemented for other exhaust aftertreatment systems, and utilized for any logically relevant type of motor vehicle. Lastly, the drawings presented herein are not necessarily to scale and are provided purely for instructional purposes. Thus, the specific and relative dimensions shown in the drawings are not to be construed as limiting.

There is shown in FIG. 1 an example of a multi-cylinder, dual overhead cam (DOHC), inline-type ICE assembly 12. The illustrated ICE assembly 12 is a four-stroke reciprocating-piston engine configuration that operates to propel the vehicle 10, for example, as a direct injection gasoline engine, including flexible-fuel vehicle (FFV) and hybrid vehicle variations thereof. The ICE assembly 12 may optionally operate in any of an assortment of selectable combustion modes, including a homogeneous-charge compression-ignition (HCCI) combustion mode and other compression-ignition (CI) combustion modes. Additionally, the ICE assembly 12 may operate at a stoichiometric air/fuel ratio and/or at an air/fuel ratio that is primarily lean of stoichiometry. This engine 12 includes a series of reciprocating pistons 16 slidably movable in cylinder bores 15 of an engine block 13. The top surface of each piston 16 cooperates with the inner periphery of its corresponding cylinder 15 and a recessed chamber surface 19 of a cylinder head 25 to define a variable volume combustion chambers 17. Each piston 16 is connected to a rotating crankshaft 11 by which linear reciprocating motion of the pistons 16 is output, for example, to a power transmission (not shown) as rotational motion via the crankshaft 11.

An air intake system transmits intake air to the cylinders 15 through an intake manifold 29, which directs and distributes air into the combustion chambers 17, e.g., via intake runners of the cylinder head 25. The engine's air intake system has airflow ductwork and various electronic devices for monitoring and controlling the flow of intake air. The air intake devices may include, as a non-limiting example, a mass airflow sensor 32 for monitoring mass airflow (MAF) 33 and intake air temperature (IAT) 35. A throttle valve 34 controls airflow to the ICE assembly 12 in response to a control signal (ETC) 120 from a programmable engine control unit (ECU) 5. A pressure sensor 36 operatively coupled to the intake manifold 29 monitors, for instance, manifold absolute pressure (MAP) 37 and barometric pressure. An optional external flow passage recirculates exhaust gases from engine exhaust to the intake manifold 29, e.g., via a control valve in the nature of an exhaust gas recirculation (EGR) valve 38. The programmable ECU 5 controls mass flow of exhaust gas to the intake manifold 29 by regulating the opening and closing of the EGR valve 38 via EGR command 139. In FIG. 1, the arrows connecting ECU 5 with the various components of the ICE assembly 12 are emblematic of electronic signals or other communication exchanges by which data and/or control commands are transmitted from one component to the other.

Airflow from the intake manifold 29 into each combustion chamber 17 is controlled by one or more dedicated intake engine valves 20. Evacuation of exhaust gases out of the combustion chamber 17 to an exhaust aftertreatment system 55 via an exhaust manifold 39 is controlled by one or more dedicated exhaust engine valves 18. In accord with at least some of the disclosed embodiment, exhaust aftertreatment system 55 includes an exhaust gas recirculation (EGR) system and/or a selective catalytic reduction (SCR) system. The engine valves 18, 20 are illustrated herein as spring-biased poppet valves; however, other known types of engine valves may be employed. The ICE assembly 12 valve train system is equipped to control and adjust the opening and closing of the intake and exhaust valves 20, 18. According to one example, the activation of the intake and exhaust valves 20, 18 may be respectively modulated by controlling intake and exhaust variable cam phasing/variable lift control (VCP/VLC) devices 22 and 24. These two VCP/VLC devices 22, 24 are configured to control and operate an intake camshaft 21 and an exhaust camshaft 23, respectively. Rotation of these intake and exhaust camshafts 21 and 23 are linked and/or indexed to rotation of the crankshaft 11, thus linking openings and closings of the intake and exhaust valves 20, 18 to positions of the crankshaft 11 and the pistons 16.

The intake VCP/VLC device 22 may be fabricated with a mechanism operative to switch and control valve lift of the intake valve(s) 20 in response to a control signal (iVLC) 125, and variably adjust and control phasing of the intake camshaft 21 for each cylinder 15 in response to a control signal (iVCP) 126. In the same vein, the exhaust VCP/VLC device 24 may include a mechanism operative to variably switch and control valve lift of the exhaust valve(s) 18 in response to a control signal (eVLC) 123, and variably adjust and control phasing of the exhaust camshaft 23 for each cylinder 15 in response to a control signal (eVCP) 124. The VCP/VLC devices 22, 24 may be actuated using any one of electro-hydraulic, hydraulic, electro-mechanic, and electric control force, in response to respective control signals eVLC 123, eVCP 124, iVLC 125, and iVCP 126, for example.

With continuing reference to the representative configuration of FIG. 1, ICE assembly 12 employs a gasoline direct injection (GDI) fuel injection subsystem with multiple high-pressure fuel injectors 28 that directly inject pulses of fuel into the combustion chambers 17. Each cylinder 15 is provided with one or more fuel injectors 28, which activate in response to an injector pulse width command (INJ_PW) 112 from the ECU 5. These fuel injectors 28 are supplied with pressurized fuel by a fuel distribution system (not shown). One or more or all of the fuel injectors 28 may be operable, when activated, to inject multiple fuel pulses (e.g., a succession of first, second, third, etc., injections of fuel mass) per working cycle into a corresponding one of the ICE assembly cylinders 15. The ICE assembly 12 employs a spark-ignition subsystem by which fuel-combustion-initiating energy—typically in the nature of an abrupt electrical discharge—is provided via a spark plug 26 for igniting, or assisting in igniting, cylinder charges in each of the combustion chambers 17 in response to a spark command (IGN) 118 from the ECU 5. Aspects and features of the present disclosure may be similarly applied to compression-ignited (CI) diesel engines.

The ICE assembly 12 is equipped with various sensing devices for monitoring engine operation, including a crank sensor 42 having an output indicative of, e.g., crankshaft crank angle, torque and/or speed (RPM) signal 43. A temperature sensor 44 is operable to monitor, for example, one or more engine-related temperatures (e.g., coolant temperature, fuel temperature, exhaust temperature, etc.), and output a signal 45 indicative thereof. An in-cylinder combustion sensor 30 monitors combustion-related variables, such as in-cylinder combustion pressure, charge temperature, fuel mass, air-to-fuel ratio, etc., and output a signal 31 indicative thereof. An exhaust gas sensor 40 is configured to monitor an exhaust-gas related variables, e.g., actual air/fuel ratio (AFR), burned gas fraction, etc., and output a signal 41 indicative thereof.

The combustion pressure and the crankshaft speed may be monitored by the ECU 5, for example, to determine combustion timing, i.e., timing of combustion pressure relative to the crank angle of the crankshaft 11 for each cylinder 15 for each working combustion cycle. It should be appreciated that combustion timing may be determined by other methods. Combustion pressure may be monitored by the ECU 5 to determine an indicated mean effective pressure (IMEP) for each cylinder 15 for each working combustion cycle. The ICE assembly 12 and ECU 5 cooperatively monitor and determine states of IMEP for each of the engine cylinders 15 during each cylinder firing event. Alternatively, other sensing systems may be used to monitor states of other combustion parameters within the scope of the disclosure, e.g., ion-sense ignition systems, EGR fractions, and non-intrusive cylinder pressure sensors.

Control module, module, controller, control unit, electronic control unit, processor and similar terms mean any one or various combinations of one or more of Application Specific Integrated Circuit(s) (ASIC), electronic circuit(s), central processing unit(s) (e.g., microprocessor(s)), and associated memory and storage (read only, programmable read only, random access, hard drive, etc.) executing one or more software or firmware programs or routines, combinational logic circuit(s), input/output circuit(s) and devices, appropriate signal conditioning and buffer circuitry, and other components to provide the described functionality. Software, firmware, programs, instructions, routines, code, algorithms and similar terms mean any controller executable instruction sets including calibrations and look-up tables. The ECU may be designed with a set of control routines executed to provide the desired functions. Control routines are executed, such as by a central processing unit, and are operable to monitor inputs from sensing devices and other networked control modules, and execute control and diagnostic routines to control operation of devices and actuators. Routines may be executed at regular intervals, for example each 100 microseconds, 3.125, 6.25, 12.5, 25 and 100 milliseconds during ongoing engine and vehicle operation. Alternatively, routines may be executed in response to occurrence of an event.

Figure 2:
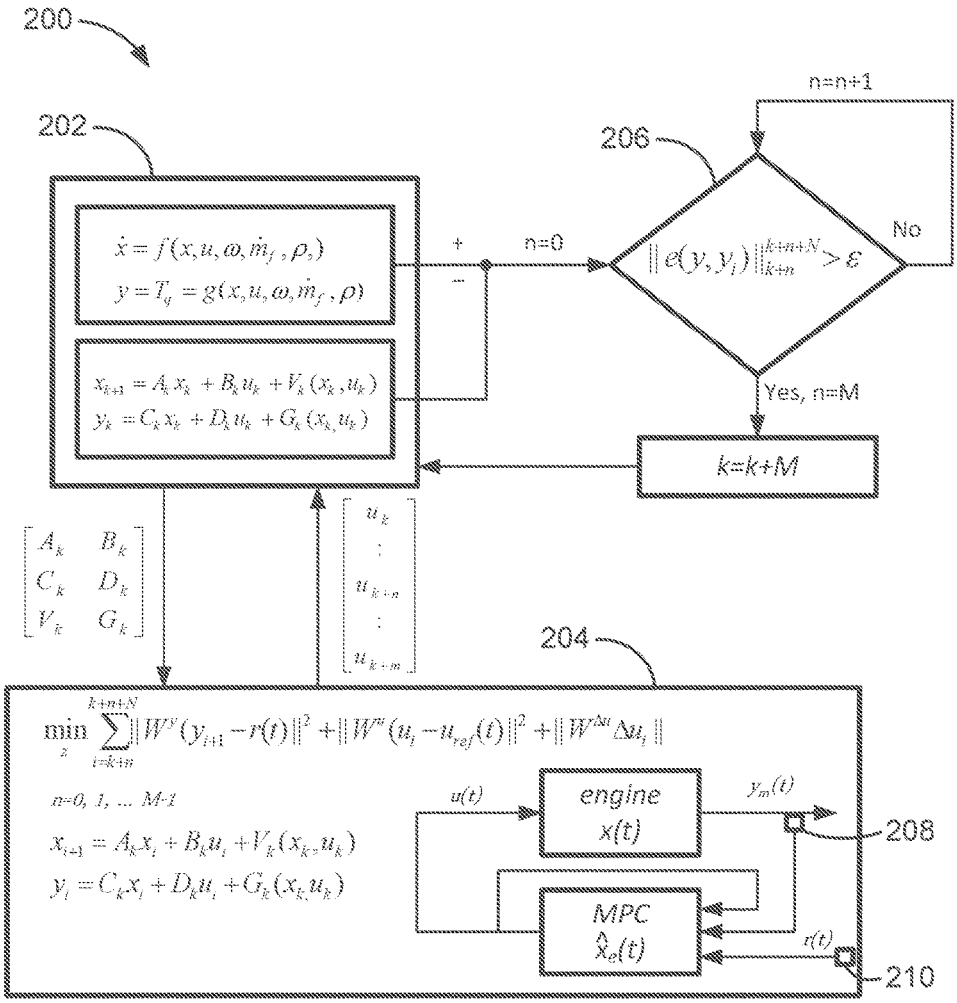
FIG. 2 is a schematic diagram of a representative piecewise LPV/MPC engine control architecture in accordance with aspects of the present disclosure.

Presented in FIG. 2 is a representative piecewise linear parameter varying (LPV) model predictive control (MPC) engine control architecture, designated generally as 200, that is operable, for example, to provide closed-loop-based engine system regulation to deliver optimal engine torque and/or to minimize combustion-generated emissions. As will be described in further detail below, the LPV/MPC architecture 200 can help to optimize combustion efficiency, and can help to provide fast torque response tracking while minimizing fuel consumption. Generally speaking, the disclosed LPV/MPC architecture 200 provides a new solution by applying model predictive control to engine systems described by piecewise linear parameter varying models. In the illustrated example, the piecewise LPV/MPC architecture 200 linearizes a physics based nonlinear engine model on-line at sparse sample times, and switches between linearized models when it is deemed to be necessary based on a criterion of the model characteristics. Employing this control scheme can help to save ECU processing time while concomitantly increasing ECU throughput without sacrificing system performance.

In the illustrated example, portions of the piecewise LPV/MPC architecture 200 are shown generally embodied as interoperable control modules—a Piecewise LPV (PLPV) module 202, a Model Predictive Control (MPC) module 204, and a Prediction Error (PO) module 206—that may each comprise a respective software application with processor-executable instructions effectuated, for example, by the onboard engine control unit (ECU) 5 of motor vehicle 10 shown in FIG. 1. For some applications, the MPC module 204 can be replaced by or supplemented with a Proportional Integral Derivative (PID) module. In the same vein, it is envisioned that each control module may comprise a discrete controller, microprocessor or other integrated circuit (IC) device, all of which are operatively interconnected to carry out any of the functions and features disclosed herein. As a closed-loop system, the PLPV, MPC and PO modules 202, 204, 206, through implementation via the ECU 5, function to regulate operation of the ICE assembly 12 and/or exhaust aftertreatment system 55 based on feedback sensory data from the engine and exhaust system (i.e., output quantities effect input quantities to the control process).

To provide closed-loop feedback data, piecewise LPV/MPC architecture 200 implements or otherwise communicates with an assortment of onboard and off-board sensing devices, including those shown in and described above with respect to FIG. 1, to aggregate relevant information for operation and optimization of the engine and exhaust system. In FIG. 2, for example, one or more engine sensors 208, which may be in the nature of a magnetoelastic, rotary transformer-type, or surface acoustic wave (SAW) torque sensor, is/are mounted on the crankshaft 11 or other appropriate component of the ICE assembly 12. Each engine sensor 208 is operable to determine—monitor in real-time, systematically or randomly track, and/or otherwise selectively detect—a measured output $y_m(t)$ of the ICE assembly, such as current engine torque (Tq), and generate one or more signals indicative thereof. Alternative system architectures may eliminate or supplement engine sensor 208 data by utilizing, for example, a stored mathematical model or lookup table to estimate engine torque or any other system parameter.

In addition to the engine sensor(s) 208, one or more input sensors 210, which may be in the nature of a linear transducer or non-contacting position sensor ("NPS"), is mounted to a "drive-by-wire" electronic throttle pedal or other appropriate component of the ICE assembly 12. Each input sensor 210 is operable to determine, e.g., monitor in real-time, systematically or randomly track, and/or otherwise selectively detect, a desired output r(t), such as a desired trajectory or desired engine torque, and generate one or more signals indicative thereof. It is envisioned that the engine control system 200 utilize greater of fewer sensors from that which are shown in the drawings, both onboard and remote from the vehicle. In the same vein, the system may utilize analog circuits or other signal processing hardware, e.g., for converting sensor information into analog electrical signals utilized in controlling engine operation. From these inputs, MPC module 204 helps to determine an optimal control input u(t), some examples of which are provided below, to help drive engine output to track the reference (so the difference between the reference and the measured output is minimal).

For a given nonlinear system, for example as seen in PLPV module 202, an engine assembly's air path and torque system may be described by a nonlinear state space model:

$$\dot{x}=f(x,u,\omega,\dot{m}_f,\rho,)$$

$$y=T_q(x,u,\omega,\dot{m}_f,\rho) \tag{1}$$

where ρ is a vector containing ambient temperature and pressure, ω is engine speed, and $\dot{m}_f$ is fuel flow. From these state space models, engine system state x and control input u can be chosen as:

$$\text{state } x = \begin{bmatrix} N_t \\ \dot{m}_a \\ p_{th} \\ p_i \end{bmatrix} \tag{2}$$

$$\text{input } u = \begin{bmatrix} u_{wg} \\ u_{th} \\ u_{IMOP} \\ u_{EMOP} \\ u_{SPK} \end{bmatrix}$$

where $N_t$ is engine turbo speed, $\dot{m}_a$ is fresh air flow, $p_{th}$ is pressure before throttle, $p_i$ is intake manifold pressure as non-limiting examples of variables of engine state x; and $u_{wg}$ is turbocharger wastegate, $u_{th}$ is air throttle, $u_{IMOP}$ is engine intake valve max open position; uEMOP is engine exhaust valve max open position, and $\underline{u}_{spk}$ is spark timing as non-limiting examples of system input u. A linearized system at a sample time k can be derived by PLPV module 202 from (or can be discretized as):

$$\frac{dx}{dt} = \underbrace{f(x_k, u_k)}_{F_0} + \underbrace{\left.\frac{\partial f}{\partial x}\right|_k}_{A}(x - x_k) + \underbrace{\left.\frac{\partial f}{\partial u}\right|_k}_{B}(u - u_k) = A_k x + B_k u + V(x_k, u_k) \tag{3}$$

$$y = g(x_k, u_k) + \underbrace{\left.\frac{\partial g}{\partial x}\right|_k}_{C}(x - x_k) + \underbrace{\left.\frac{\partial g}{\partial u}\right|_k}_{D}(u - u_k) = C_k x + D_k u + G(x_k, u_k)$$

where x is a representative engine state; dx/dt is a change of the engine state over time; $x_k$ is the engine state at sparse sample time k; u is a representative control input; $u_k$ is the control input at sparse sample time k; y is a representative system output; and $A_k$, $B_k$, $C_k$, $D_k$, $V_k$ and $G_k$ are linearized system matrices characterizing system dynamics at sparse sample time k. Taking a partial derivative, a nonlinear system can be linearized at operating points $x_k$ and uk at sparse sample time k as described by the above equations. The linearized system at sparse sample time k is supplied by the PLPV module 202 to MPC module 204 for the optimization algorithm, as described in further detail below.

Starting at sample time k, the MPC control module 204 can determine and output to PLPV module 202 an optimal control sequence $u_k, u_{k+1}, \ldots u_N$, such that it minimizes a cost function:

$$\min_u \sum_{i=k}^{k+N} \|W^y(y_{i+1} - r(t)\|^2 + \|W^u(u_i - u_{ref}(t)\|^2 + \|W^{\Delta u}\Delta u_i\| \quad (4)$$

where $y_{i+1}$ is a representative system output at sample time i+1; in this instance, r(t) is a reference for a control output; $u_i$ is a representative control input at sample time i; $u_{ref}$ is a control input reference; and $W^y$, $W^u$ and $W^{\Delta u}$ are weighting factors in the optimization. Optimization of the cost function can be subject to one or more linearized system dynamic constraints:

$$x_{i+1} = A_k x_i + B_k u_i + V_k(x_k, u_k)$$

$$y_i = C_k x_i + D_k u_i + G_k(x_k, u_k) \quad (5)$$

where $x_i$ is a representative engine state at sample time i; $x_{i+1}$ is an engine state at sample time i+1; $u_i$ is a control input at sample time i; $y_i$ is a representative system output at sample time i. The symbol ||*|| is representative of a norm of a vector, i.e., a general vector norm, which is a measure of respective magnitudes of the variables in the norm.

Optimization to minimize the cost function shown above in equation (4) helps to find a control sequence $u_k$, $u_{k+1}, \ldots u_N$ that can be implemented, for example, to control linear system responses $y_k$, $y_{k+1}$, and $y_N$ to track the reference signal r(t), e.g., such that the difference between $\|y_i - r(t)\|$ is small. In this example, N·Δt can be used to denote a prediction time horizon, which contains N number of samples of the system with sample time Δt. A first norm in the cost function helps to minimize a tracking error between the system measured output y and the reference r(t). A second and a third norm in the cost function may be representative of certain constraints on the control signal, e.g., to help ensure the control signal does not step jump too significantly, or significantly away from a certain input reference $u_{ref}$. Once an optimal control sequence is found, a first control element $u_k$ may be applied to the engine assembly 12, e.g., via the MPC module 204 of FIG. 2. The optimal control sequence may be provided by the MPC module 204 to the PLPV module 202 to simulate system model responses.

The above process may then be repeated, moving forward to calculate an optimal control at a next sample time (k+1). This may require determining a new linearized system of the original nonlinear system at next sample time (k+1), e.g., via PLPV module 202, which may require calculating a new control sequence $u_{k+1}, u_{k+2}, \ldots u_{N+1}$, e.g., via the MPC module 204. The piecewise LPV/MPC architecture 200 repeats this process at each sample time to find an optimal control element for each prediction horizon moving forward in real-time. This process helps to avoid the complexity associated with zone partition calibration. In practice, finding an optimal control sequence for each linearized system model, when calculating the MPC optimal control, may require solving a quadratic program whose formulation relies on complicated manipulation of matrices $A_k$, $B_k$, $C_k$, $D_k$, $V_k$ and $G_k$ at sample time k. Formulating and then solving this quadratic program tends to consume a large amount of computational time and memory of ECU throughput. This computational burden may prevent ECU/ECU resources from completing other tasks.

To help eliminate the aforementioned computational burden associated with calibration complexity in zone based MPC algorithms and computational complexity of LPV/MPC optimization processes, the representative engine system control architecture 200 presented in FIG. 2 utilizes a piecewise LPV/MPC control routine that obtains a linearized system $A_k$, $B_k$, $C_k$, $D_k$, $V_k$, and $G_k$ at sparse sample time k, then applying MPC control to find an optimal control sequence $u_k, u_{k+1}, \ldots u_N$, then find an optimal control element $u_k$ that is applied to the engine assembly 12. This control sequence is applied to simulate both the linearized system and the original nonlinear model. If the responses of both system models are within a predetermined tolerance—a calibrated threshold—at next sample time (k+1), e.g., as determined by PO module 206, PLPV module 202 will forego linearizing another system model or conduct a new quadratic programming optimization. Instead, the control model utilizes the existing quadratic programming algorithm based on the existing linear system model ($A_k$, $B_k$, $C_k$, $D_k$, $V_k$, and $G_k$) obtained at sample time k to find the next optimal control sequence $u_{k+1}, u_{k+2}, \ldots u_{N+1}$. This process may iterate in a continuous loop until current predicted responses from the linear system model at past sample time k deviate significantly from current predicted responses of the nonlinear system model. Responsive to one or more predicted responses of the linear and nonlinear system models deviating from a calibrated threshold, a new linearized system is generated.

Figure 3:
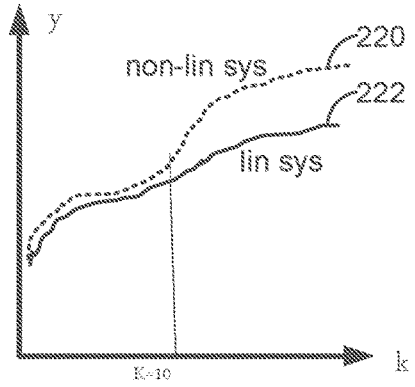
FIG. 3 is a chart illustrating an example of piecewise LPV/MPC engine system control in accordance with aspects of the present disclosure, where a nonlinear system model is generated and linearized at sparse sample times k when linear model accuracy is sufficient at prediction horizons based on on-line test criterion.

Application of the above piecewise LPV/MPC engine control routine is represented in FIG. 3, where a nonlinear system model 220 is linearized at sparse sample time k to generate linear system model 222 when linear model accuracy is sufficient at prediction horizons based on on-line test criterion. From this plot, as an illustrative example, the piecewise LPV/MPC architecture 200 eliminates the need to linearize the nonlinear system model at every sample time; rather, the system merely needs to linearize the nonlinear system at sparse sample points, for example, at k=0, k=10, k=20, and k=35. In between these sparse sample times, the LPV/MPC architecture 200 uses the existing quadratic programming algorithm at a pre-determined sparse sample time k to find a current optimal control sequence.

PO module 206 compares system responses to determine if a new linearized system model is needed; if so, PO module 206 may responsively reset for a next linearization. There are several methods that can be used to calculate prediction errors in order to determine when the next linearization model is needed. In FIG. 2, e(y, $y_i$) represents a modeling error as a function of the response sequences (or vectors) y of the nonlinear system model and $y_i$ of the linearized system model. In the illustrated example:

$$\|e(y, y_i)\|_{k+n}^{k+n+N} \quad (6)$$

defines a vector norm calculated for a number of samples N. There are several proposed ways to measure the norm, such as:

$$1).\|e(y, y_i)\|_{k+n}^{k+n+N} = \max|y - y_i|,\ i = [k + n\ k + n + N]). \quad (7)$$

$$2).\|e(y, y_i)\|_{k+n}^{k+n+N} = \sqrt{\frac{1}{N}\sum_{i=k+n}^{k+n+N} [(y - y_i)/y]^2}$$

These approaches are known as "error based switching" test functions. In the first example method of equation set (7), for a number of samples N, the norm can be defined as a maximum absolute difference between the nonlinear system response and the linearized system response during the prediction window. In the second example method of equation set (7), a norm can be defined as a root mean square of the relative errors of the response differences between the original nonlinear model and the linearized model.

In a third method:

$$der_1=A_{k-1}x(k|k-1)+B_{k-1}\bar{u}+v_{k-1}\ der2=f(x(k|k-1),\bar{u})$$

$$\text{switch if } \|der_1-der_2\|>\varepsilon, \tag{8}$$

This method calculates the derivative of the nonlinear system $der_2(k+1)=f(x_k,u_k\omega_k,\ m_{fk})$ and the next state of the linearized system $der_1(k+1)=x_{k+1}=A_kx_k+B_ku_k+V_k$, when $\|e(y,yi)\|=|\ der_2(k+1)-der_1(k+1)|>\varepsilon$, switch to another linearized model.

Model switching, as indicated in equation (8) below, can also be utilized based on checking among linearized models to avoid solving a new optimization problem at each sample time. Put another way, model switching can be determined by checking a difference among linearized models to avoid solving a new quadratic programming or computationally extensive optimization problem at each sample time:

$$4).\ \text{difference}(\text{LinSys}(k),\text{LinSys}(k+n))>\varepsilon,n=M,(n=1,2,3\ldots) \tag{9}$$

The difference can be calculated based on outputs of two linear systems at a prediction horizon, or the characteristic properties of the two linear systems. Here, LinSys(k) is the linearized system at sample time k:

$$x_{k+1}=A_kx_k+B_ku_k+V_k(x_k,u_k)$$

$$y_k=C_kx_k+D_ku_k+G_k(x_k,u_k) \tag{10}$$

where LinSys(k+n) is the linearized system at sample time k+n:

$$x_{k+n+1}=A_{k+n}x_{k+n}+B_{k+n}u_{k+n}+V_{k+n}(x_{k+n},u_{k+n})$$

$$y_{k+n}=C_{k+n}x_{k+n}+D_{k+n}u_{k+n}+G_{k+n}(x_{k+n},u_{k+n}) \tag{11}$$

The difference can be calculated based on outputs of two linear systems at a prediction horizon, or the characteristic properties of the two linear systems, such as system poles and zeros.

Figure 4:
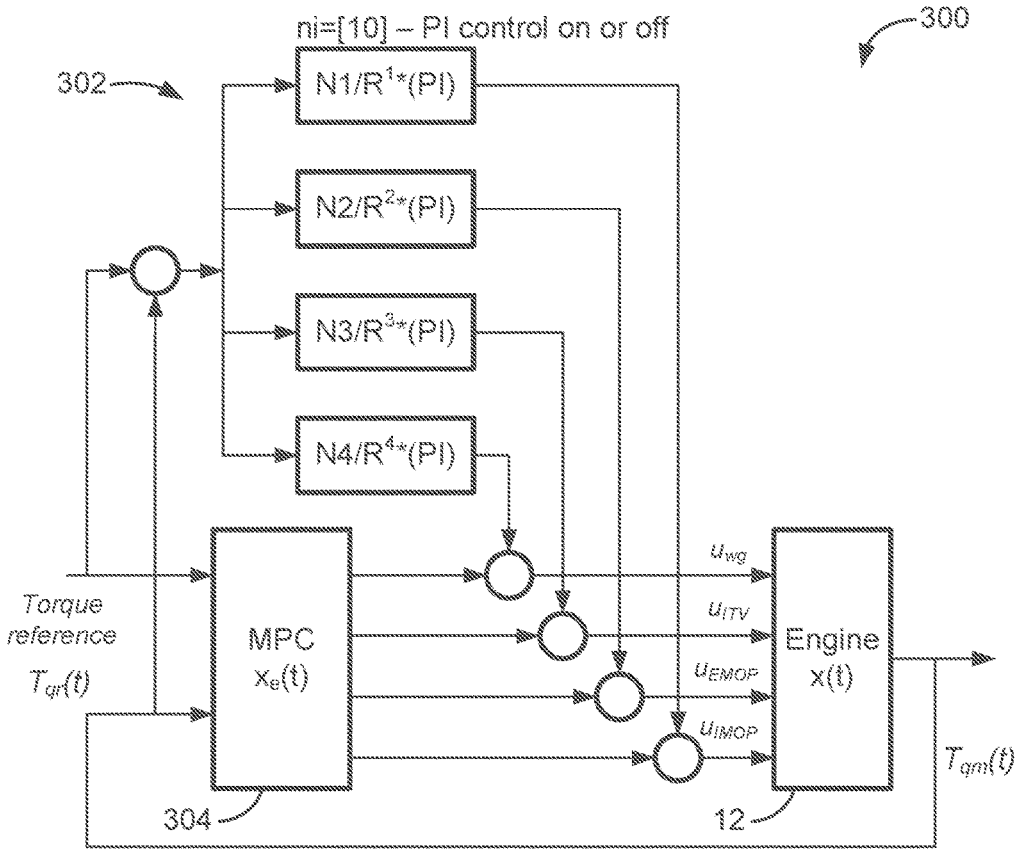
FIG. 4 is a schematic diagram of a representative piecewise LPV/MPC engine torque and emission closed-loop control architecture in accordance with aspects of the present disclosure.

FIG. 4 schematically illustrates a representative piecewise LPV/MPC engine torque and emission closed-loop control architecture 300. While differing in appearance, the architecture 300 presented in FIG. 4 may incorporate, singly or in combination, any of the features and options disclosed above and below with respect to the other engine system control architectures, and vice versa. In this example, $T_{qm}(t)$ is a measured torque of engine assembly 12, and $T_{qr}(t)$ is a reference torque tracked alongside the measured torque by robust MPC control module 304. Optimal control outputs are represented in FIG. 4, for example, as: an optimal wastegate position $u_{wg}$; an optimal throttle position $u_{ITV}$; an optimal intake valve position $u_{IMOP}$; and an optimal exhaust valve position $u_{EMOP}$. One or more or all of these control outputs can be used to control engine assembly 12 such that the resultant torque $T_{qm}$ tracks the reference torque $T_{qr}$. Since MPC is a model based control algorithm, modeling error may sometimes prevent the engine torque from tracking the reference torque accurately. In this case, however, one can add several proportional and integral (PI) controllers, collectively designated at 302. In an example, these PI controllers 302 may be implemented based, for example, on one or more control errors between the engine measured torque and reference torque to modify the MPC control $u_{wg}$, $u_{ITV}$, $u_{IMOP}$, $u_{EMOP}$, in order to make the measured torque track the reference torque more accurately. In this diagram, R1, R2, R3 and R4 are weighting functions in an MPC cost function, n1, n2, n3, n4 are binary numbers, taking values either 1 or 0. In this instance, 1 operates to turn on the corresponding PI controller for a particular actuator; conversely, 0 will operate to turn off the PI control to that actuator.

Figure 5:
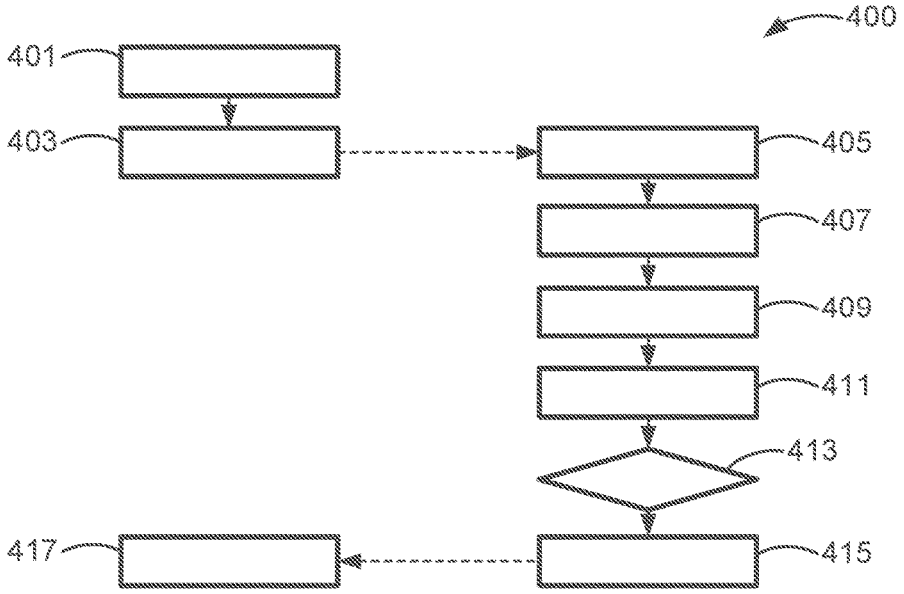
FIG. 5 is a flowchart for an engine system control algorithm with a piecewise LPV/MPC engine system control routine that may correspond to instructions executed by onboard control-logic circuitry, programmable engine control unit, or other computer-based device of a motor vehicle in accord with aspects of the disclosed concepts.

With reference now to the flow chart of FIG. 5, an improved method or control strategy for operating a piecewise LPV/MPC engine control system for regulating operation of an internal combustion engine, such as ICE assembly 12 of FIG. 1, for a motor vehicle, such as the automobile 10, for example, is generally described at 400 in accordance with aspects of the present disclosure. FIG. 5 can be representative of an algorithm that corresponds to processor-executable instructions that can be stored, for example, in main or auxiliary memory, and executed, for example, by an ECU, CPU, an on-board or remote vehicle control logic circuit, or other device, to perform any or all of the above and/or below described functions associated with the disclosed concepts.

The method 400 of FIG. 4 starts at block 401 with receiving, e.g., via MPC module 204 of FIG. 2, one or more signals indicative of current engine torque output, e.g., from an engine sensor 208. Block 401 may further comprise MPC module 204 receiving one or more signals indicative of desired engine torque, e.g., from input sensor 210. At block 403, the method 400 then determines, from the received signals indicative of desired engine torque and engine torque output, an optimal control command for the engine assembly using a piecewise LPV/MPC routine. This piecewise LPV/MPC routine, which may comprise any of the aspects and features discussed above with respect to FIGS. 1-4, is collectively represented at blocks 405-413.

With continuing reference to FIG. 5, method 400 continues to block 405, which may be representative of a first instruction within the piecewise LPV/MPC routine, to determine a nonlinear system model of engine torque for the engine assembly. This may comprise building a nonlinear physics-based plant model, e.g., for an engine air-charging system and torque model. At block 407, a linear system model is determined for the engine assembly at a current engine operating condition. As described above, this may comprise linearizing the nonlinear plant model at a current operating condition, and calculating a system dynamic matrix A, B, C, D and V based on a Jacobian matrix from derivatives of nonlinear system function.

The piecewise LPV/MPC routine continues to block 409 to minimize or otherwise optimize a control cost function in a receding horizon for the linear system model, and then, at block 411, determine respective system responses for the nonlinear and linear system models with a current optimal control input. As noted above, once the nonlinear plant model is linearized, a control cost function in receding finite time horizon is optimized against the current linearized system, and a control solution is determined for a current step. Both the nonlinear system response and the linearized system response may be simulated with a current optimal control input u(k).

At step 413, piecewise LPV/MPC routine determines if a norm of an error function between the system responses is smaller than a predetermined threshold. As indicated above, a vector or time series norm may be calculated based on an error function between the two responses; if the norm is smaller than the predetermined threshold, this linearized system and corresponding A, B, C, D and V matrices may be re-used in a next sampling time for a next receding horizon to find an optimal control u(k+1). Thus, at block 415, if the norm is determined to be smaller than the predetermined threshold, the piecewise LPV/MPC routine will apply the linearized system model in a next sampling time for a next receding horizon to determine the optimal control command. This process may iterate in a continuous loop, for example, until a norm of the error response is deemed to be no longer acceptable. When no longer acceptable, a new linearized system model is obtained to calculate a new control series. When an optimal control command is determined, block 415 will output the control command to the engine assembly.

Aspects of this disclosure may be implemented, in some embodiments, through a computer-executable program of instructions, such as program modules, generally referred to as software applications or application programs executed by an on-board vehicle computer. The software may include, in non-limiting examples, routines, programs, objects, components, and data structures that perform particular tasks or implement particular abstract data types. The software may form an interface to allow a computer to react according to a source of input. The software may also cooperate with other code segments to initiate a variety of tasks in response to data received in conjunction with the source of the received data. The software may be stored on any of a variety of memory media, such as CD-ROM, magnetic disk, bubble memory, and semiconductor memory (e.g., various types of RAM or ROM).

Moreover, aspects of the present disclosure may be practiced with a variety of computer-system and computer-network configurations, including multiprocessor systems, microprocessor-based or programmable-consumer electronics, minicomputers, mainframe computers, and the like. In addition, aspects of the present disclosure may be practiced in distributed-computing environments where tasks are performed by remote-processing devices that are linked through a communications network. In a distributed-computing environment, program modules may be located in both local and remote computer-storage media including memory storage devices. Aspects of the present disclosure may therefore, be implemented in connection with various hardware, software or a combination thereof, in a computer system or other processing system.

Any of the methods described herein may include machine readable instructions for execution by: (a) a processor, (b) a controller, and/or (c) any other suitable processing device. Any algorithm, software, or method disclosed herein may be embodied in software stored on a tangible medium such as, for example, a flash memory, a CD-ROM, a floppy disk, a hard drive, a digital versatile disk (DVD), or other memory devices, but persons of ordinary skill in the art will readily appreciate that the entire algorithm and/or parts thereof could alternatively be executed by a device other than a controller and/or embodied in firmware or dedicated hardware in a well-known manner (e.g., it may be implemented by an application specific integrated circuit (ASIC), a programmable logic device (PLD), a field programmable logic device (FPLD), discrete logic, etc.). Further, although specific algorithms are described with reference to flowcharts depicted herein, persons of ordinary skill in the art will readily appreciate that many other methods of implementing the example machine readable instructions may alternatively be used. For example, the order of execution of the blocks may be changed, and/or some of the blocks described may be changed, eliminated, or combined.

While aspects of the present disclosure have been described in detail with reference to the illustrated embodiments, those skilled in the art will recognize that many modifications may be made thereto without departing from the scope of the present disclosure. The present disclosure is not limited to the precise construction and compositions disclosed herein; any and all modifications, changes, and variations apparent from the foregoing descriptions are within the spirit and scope of the disclosure as defined in the appended claims. Moreover, the present concepts expressly include any and all combinations and subcombinations of the preceding elements and features.

What is claimed:

1. A linear parameter varying (LPV) model predictive control (MPC) engine control system for an engine assembly, the LPV/MPC engine control system comprising:

an engine sensor configured to detect engine torque output of the engine assembly and generate a signal indicative thereof;

an input sensor configured to detect desired engine torque for the engine assembly and generate a signal indicative thereof; and an engine control unit communicatively connected to the engine sensor, and the input sensor, the engine control unit being programmed to:

receive, from the engine and input sensors, signals indicative of a desired engine torque and an engine torque output;

determine, from the desired engine torque and engine torque output, an optimal control command using a piecewise LPV/MPC routine, including:

determine a nonlinear system model of engine torque for the engine assembly, determine a linear system model for the engine assembly at a current engine operating condition, minimize a control cost function in a receding horizon for the linear system model, determine respective system responses for the nonlinear and linear system models with a current optimal control input, determine if a norm of an error function between the system responses is smaller than a predetermined threshold, and responsive to a determination that the norm is smaller than the predetermined threshold, apply the linearized system model in a next sampling time for a next receding horizon to determine the optimal control command; and output the determined optimal control command to the engine assembly.

2. The LPV/MPC engine control system of claim 1, wherein the piecewise LPV/MPC routine further includes, responsive to the determination that the norm is smaller than the predetermined threshold, executing the following in a continuous loop, starting at sample time k, until it is determined that the norm is not smaller than the predetermined threshold:

minimize the control cost function at next sampling times k+1, 2 . . . N in respective next receding horizons for the linear system model, determine new respective system responses for the nonlinear and linear system models with the current optimal control input, and determine if the norm of the error function between the new system responses is smaller than the predetermined threshold.

3. The LPV/MPC engine control system of claim 1, wherein the piecewise LPV/MPC routine further includes, responsive to a determination that the norm is not smaller than the predetermined threshold:

determine a new linear system model for the engine assembly, minimize the control cost function in a new receding horizon for the new linear system model, determine new respective system responses for the nonlinear system model and the new linear system model with the current optimal control input, and determine if the norm of the error function between the new system responses is smaller than the predetermined threshold.

4. The LPV/MPC engine control system of claim 1, wherein determining the linear system model for the engine assembly includes calculating a system dynamic matrix A, B, C, D and V at a sample time k.

5. The LPV/MPC engine control system of claim 1, wherein determining the linear system model includes linearizing the nonlinear system model at sample time k according to:

$$\frac{dx}{dt} = \underbrace{f(x_k, u_k)}_{F_0} + \underbrace{\frac{\partial f}{\partial x}\bigg|_k}_{A}(x - x_k) + \underbrace{\frac{\partial f}{\partial u}\bigg|_k}_{B}(u - u_k) = A_k x + B_k u + V(x_k, u_k)$$

$$y = g(x_k, u_k) + \underbrace{\frac{\partial g}{\partial x}\bigg|_k}_{C}(x - x_k) + \underbrace{\frac{\partial g}{\partial u}\bigg|_k}_{D}(u - u_k) = C_k x + D_k u + G(x_k, u_k)$$

where x is an engine state; $x_k$ is the engine state at sparse sample time k; u is a control input;

$u_k$ is the control input at sparse sample time k; y is a system output; and $A_k$, $B_k$, $C_k$, $D_k$, $V_k$ and $G_k$ are linearized system matrices characterizing system dynamics at sparse sample time k.

6. The LPV/MPC engine control system of claim 5, wherein the engine state includes a turbo speed, a fresh mass air flow, a pressure before throttle, or an intake manifold pressure, or any combination thereof.

7. The LPV/MPC engine control system of claim 5, wherein the control input includes a turbocharger wastegate input, an air throttle input, an engine intake valve max open position input, an engine exhaust valve max open position.

8. The LPV/MPC engine control system of claim 1, wherein determining the nonlinear system model includes building a nonlinear physics-based plant model for the engine assembly.

9. The LPV/MPC engine control system of claim 8, wherein determining the linear system model includes linearizing the nonlinear physics-based plant model at the current operating condition, and calculating a system dynamic matrix A, B, C, D and V based on a Jacobian matrix from derivatives of a nonlinear system function.

10. The LPV/MPC engine control system of claim 9, wherein the cost function is minimized at a sample time k in accordance with:

$$\min_u \sum_{i=k}^{k+N} \|W^y(y_{i+1} - r(t)\|^2 + \|W^u(u_i - u_{ref}(t)\|^2 + \|W^{\Delta u}\Delta u_i\|$$

where $y_{i+1}$ is a system output at sample time i+1; r(t) is a reference for controlled output; $u_i$ is a control input at sample time i; $u_{ref}$ is a control input reference; and $W^y$, $W^u$ and $W^{\Delta u}$ are weighting factors in the optimization.

11. The LPV/MPC engine control system of claim 10, wherein minimizing the cost function is subject to system constraints:

$$x_{i+1} = A_k x_i + B_k u_i + V_k(x_k, u_k)$$

$$y_i = C_k x_i + D_k u_i + G_k(x_k, u_k)$$

where $x_i$ is an engine state at sample time i; $x_i$ is an engine state at sample time i+1; $u_i$ is a control input at sample time i; $u_k$ is the control input at sparse sample time k; $y_i$ is a system output at sample time i; and $A_k$, $B_k$, $C_k$, $D_k$, $V_k$ and $G_k$ are linearized system matrices characterizing system dynamics at sparse sample time k.

12. The LPV/MPC engine control system of claim 1, wherein determining the norm of the error function includes defining a vector norm:

$$\|e(y, y_i)\|_{k+n}^{k+n+N}$$

which is calculated for N number of samples, where e(y, $y_i$) represents the error function; y is the system response of the nonlinear system model, $y_i$ is the system response of the linearized system model, and k is a sparse sample time.

13. A motor vehicle, comprising:

a vehicle body defining an engine compartment;

an internal combustion engine (ICE) assembly stowed in the engine compartment;

an engine sensor operatively coupled to the ICE assembly and configured to detect engine torque output of the ICE assembly and generate a signal indicative thereof;

an input sensor configured to detect desired engine torque for the ICE assembly and generate a signal indicative thereof; and an engine control unit communicatively connected to the ICE assembly, the engine sensor, and the input sensor, the engine control unit being programmed to:

receive, from the engine and input sensors, signals indicative of a desired engine torque and an engine torque output;

determine, from the engine torque output and the desired engine torque, an optimal control command using a piecewise LPV/MPC routine, including:

determine a nonlinear system model of engine torque for the ICE assembly, determine a linear system model for the ICE assembly at a current engine operating condition, minimize a control cost function in a receding horizon for the linear system model, determine respective system responses for the nonlinear and linear system models with a current optimal control input, determine if a norm of an error function between the system responses is smaller than a predetermined threshold, and responsive to a determination that the norm is smaller than the predetermined threshold, apply the linearized system model in a next sampling time for a next receding horizon to determine the optimal control command; and output the determined optimal control command to the ICE assembly.

14. A method of operating a linear parameter varying (LPV) model predictive control (MPC) engine control system for an engine assembly, the method comprising:

receiving, from an engine sensor, a signal indicative of an engine torque output of the engine assembly;

receiving, from an input sensor, a signal indicative of a desired engine torque for the engine assembly;

determining, from the engine torque output and the desired engine torque, an optimal control command using a piecewise LPV/MPC routine, including:

determining a nonlinear system model of engine torque for the engine assembly, determining a linear system model for the engine assembly at a current engine operating condition, minimizing a control cost function in a receding horizon for the linear system model, determining respective system responses for the nonlinear and linear system models with a current optimal control input, determining if a norm of an error function between the system responses is smaller than a predetermined threshold, and responsive to a determination that the norm is smaller than the predetermined threshold, applying the linearized system model in a next sampling time for a next receding horizon to determine the optimal control command; and outputting the determined optimal control command to the engine assembly.

15. The method of claim 14, wherein the piecewise LPV/MPC routine further includes, responsive to the determination that the norm is smaller than the predetermined threshold, executing the following in a continuous loop, at sample time k, until it is determined that the norm is not smaller than the predetermined threshold:

minimizing the control cost function at next sampling time k+1, 2 . . . N in a respective next receding horizon for the linear system model, determining new respective system responses for the nonlinear and linear system models with the current optimal control input, and determining if the norm of the error function between the new system responses is smaller than the predetermined threshold.

16. The method of claim 15, wherein the piecewise LPV/MPC routine further includes, responsive to a determination that the norm is not smaller than the predetermined threshold:

determining a new linear system model for the engine assembly, minimizing the control cost function in a new receding horizon for the linear system model, determining new respective system responses for the nonlinear system model and the new linear system model with the current optimal control input, and determining if the norm of the error function between the new system responses is smaller than the predetermined threshold.

17. The method of claim 16, wherein determining a new linear system model includes determining multiple new linear system models responsive to multiple determinations that the norm is not smaller than the predetermined threshold, and wherein determining the multiple new linear system models is performed at non-sequential sample times.

18. The method of claim 15, wherein determining the linear system model for the engine assembly includes calculating a system dynamic matrix A, B, C, D and V at a sample time k.

19. The method of claim 15, wherein determining the nonlinear system model includes building a nonlinear physics-based plant model for the engine assembly.

20. The method of claim 19, wherein determining the linear system model includes linearizing the nonlinear physics-based plant model at the current operating condition, and calculating a system dynamic matrix A, B, C, D and V based on a Jacobian matrix from derivatives of nonlinear system function.

* * * * *